US012523102B2

(12) United States Patent
Lay et al.

(10) Patent No.: US 12,523,102 B2
(45) Date of Patent: Jan. 13, 2026

(54) DOWN-THE-HOLE HAMMER HAVING AN INVERTED CASING

(71) Applicant: Center Rock Inc., Berlin, PA (US)

(72) Inventors: Warren Thomas Lay, Catawba, VA (US); Austin C. Hine, New Florence, PA (US)

(73) Assignee: Center Rock, Inc., Berlin, PA (US)

( * ) Notice: Subject to any disclaimer, the term of this patent is extended or adjusted under 35 U.S.C. 154(b) by 0 days.

(21) Appl. No.: 18/785,640

(22) Filed: Jul. 26, 2024

(65) Prior Publication Data

US 2025/0034955 A1 Jan. 30, 2025

Related U.S. Application Data

(60) Provisional application No. 63/516,272, filed on Jul. 28, 2023.

(51) Int. Cl.
*E21B 17/046* (2006.01)
*E21B 10/36* (2006.01)

(52) U.S. Cl.
CPC ..... *E21B 17/046* (2013.01); *E21B 10/36* (2013.01)

(58) Field of Classification Search
CPC ..... E21B 4/06; E21B 4/14
See application file for complete search history.

(56) References Cited

U.S. PATENT DOCUMENTS 4,706,764 A 11/1987 Hughes
5,803,187 A * 9/1998 Javins ..... E21B 4/16 175/57
8,141,663 B2 3/2012 Lyon et al.
10,161,188 B2 12/2018 Lorger
10,550,641 B2 * 2/2020 Tsang ..... E21B 4/10
2009/0071725 A1 * 3/2009 Purcell ..... E21B 7/28 175/415
2011/0031020 A1 * 2/2011 Cote ..... E21B 4/14 175/57
2011/0036636 A1 * 2/2011 Lyon ..... E21B 4/14 175/293
2012/0145464 A1 * 6/2012 Gien ..... E21B 10/36 175/414
2016/0153237 A1 * 6/2016 Lorger ..... E21B 4/14 175/296
2021/0145464 A1 * 5/2021 Taylor ..... A61B 17/00234

FOREIGN PATENT DOCUMENTS

JP 07247780 A * 9/1995
JP H07247780 A 9/1995
WO 2020104527 A1 † 5/2020

OTHER PUBLICATIONS

International Search Report in counterpart application No. PCT/US2024/039842, mailed Oct. 24, 2024.
Written Opinion of the International Searching Authority in counterpart application No. PCT/US2024/039842, mailed Oct. 24, 2024.

* cited by examiner
† cited by third party

*Primary Examiner* — David Carroll
(74) *Attorney, Agent, or Firm* — Kim IP Law Group LLC

(57) ABSTRACT

A down-the-hole drill hammer comprising a casing having externally threaded distal end, and a chuck having internal threads threadedly connectable to the distal end of the casing. The down-the-hole drill hammer further comprising a drill bit having a head and a shank extending proximally from the head, and a bit retaining ring between the casing and the chuck for releasably retaining the drill bit.

20 Claims, 9 Drawing Sheets

DOWN-THE-HOLE HAMMER HAVING AN INVERTED CASING

CROSS-REFERENCE TO RELATED APPLICATION(S)

This application claims the benefit under 35 U.S.C. § 119 (e) to U.S. Provisional Application No. 63/516,272, filed Jul. 28, 2023, and entitled "Down-The-Hole Hammer with Inverted Casing and Chuck Threads," the disclosure of which is hereby incorporated by reference in its entirety for all purposes.

FIELD OF THE INVENTION

The exemplary embodiments of present disclosure relate generally to a drilling device and, more specifically, to a down-the-hole (DTH) drill hammer having a short overall hammer length and a short bit shank length.

BACKGROUND OF THE DISCLOSURE

DTH percussive hammers use a casing or wear sleeve to contain the internal hammer parts, provide structure, and provide a means to attach a backhead and a chuck thereto. The chuck is typically connected to the casing via a threaded connection and is used to retain a drill bit to the hammer. The drill bit is a consumable device and needs to be changed periodically. Bit retaining rings are used to hold the drill bit in the hammer. To remove the drill bit the chuck is unthreaded from the casing and the bit retaining rings is removed. The drill bit is then able to be removed completely from the chuck.

A lengthy drill bit shank increases the weight of the drill bit as well as the overall length of the drill hammer and bit assembly. Thus, a need still exists for a DTH drill hammer having a shorter overall hammer length and a shorter drill bit shank length.

BRIEF SUMMARY OF THE DISCLOSURE

In accordance with an exemplary embodiment of the subject disclosure there is provided a down-the-hole hammer comprising a casing having externally threaded distal end, and a chuck having internal threads threadedly connectable to the distal end of the casing. The down-the-hole drill hammer further comprising a drill bit having a head and a shank extending proximally from the head, and a bit retaining ring between the casing and the chuck for releasably retaining the drill bit.

According to an aspect, a length of the drill bit shank is less than an overall diameter of the drill bit head. According to another aspect, the length of the drill bit shank is about ¾ of an overall diameter of the drill bit head.

According to an aspect, the chuck includes a shoulder. According to another aspect, the chuck includes a shoulder extending radially inwardly about a midpoint of a longitudinal length of the chuck. According to another aspect, the internal threads of the chuck are positioned about a proximal end of the chuck. According to another aspect, the chuck includes a plurality of splines. According to another aspect, the chuck includes a plurality of splines about a distal end of the chuck. According to another aspect, the chuck includes a plurality of splines each having a radially inwardly extending step. According to another aspect, the chuck has an overall outside diameter substantially the same as an overall outside diameter of a main portion of the casing.

According to an aspect, the bit retaining ring includes a planar top surface and a planar bottom surface. According to another aspect, the bit retaining ring is completely below the casing. According to another aspect, the bit retaining ring is adjacent a most distal end of the casing. According to another aspect, the bit retaining ring is sized to fit within the chuck. According to another aspect, an internal diameter of the bit retaining ring is less than an internal diameter of the distal end of the casing.

According to an aspect, the chuck and the drill bit shank have cooperating splines whereby the drill bit is axially movable relative to the chuck.

According to an aspect, the distal end of the casing has an overall outside diameter smaller than an overall outside diameter of a main portion of the casing. According to another aspect, the externally threaded distal end of the casing extends radially inwardly from a main portion of the casing. According to another aspect, the externally threaded distal end of the casing forms a radially inwardly extending shoulder. According to another aspect, the casing includes a radially inwardly extending shoulder adjacent the externally threaded distal end.

In accordance with an exemplary embodiment of the subject disclosure there is provided a down-the-hole hammer casing assembly consisting essentially of a casing, a chuck connectable to the casing, and a bit retaining ring between the casing and the chuck.

Other features and advantages of the subject disclosure will be apparent from the following more detailed description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
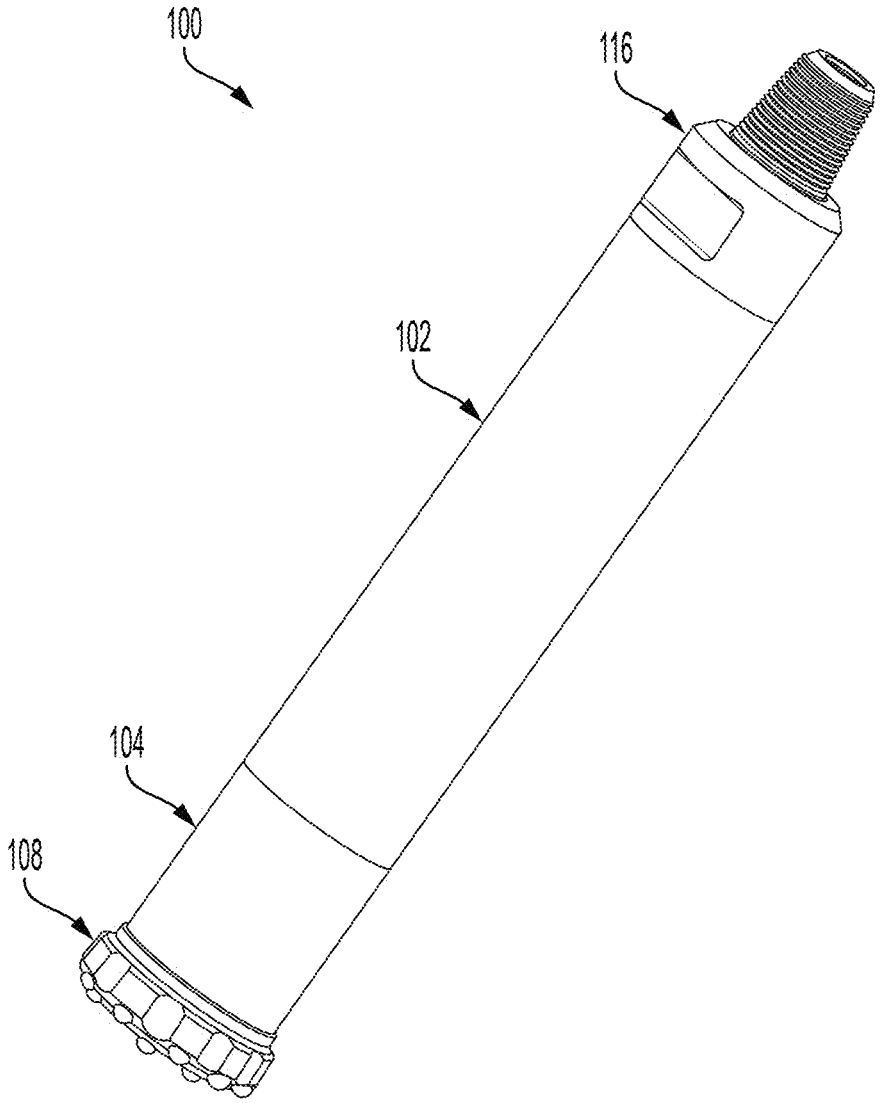
FIG. 1 is perspective view of a DTH drill hammer in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 1A:
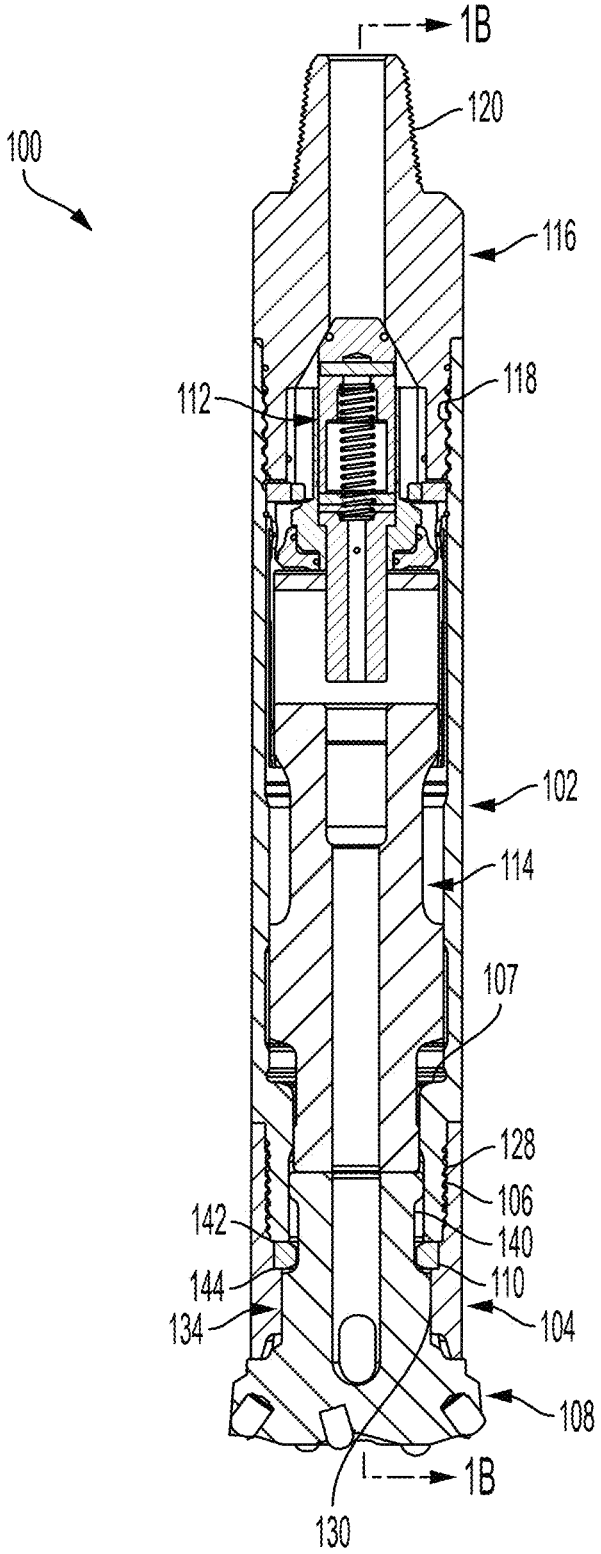
FIG. 1A is a longitudinal cross-sectional view of the DTH drill hammer of FIG. 1.
Figure 1B:
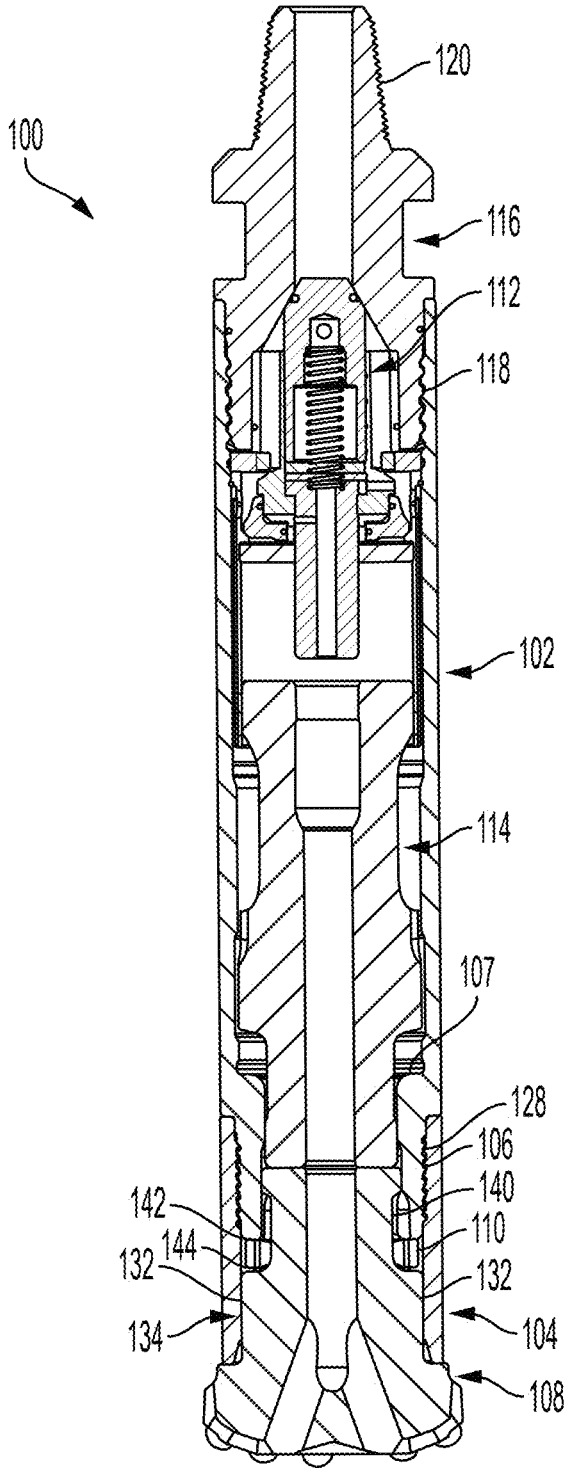
FIG. 1B is a longitudinal cross-sectional view of the DTH drill hammer taken along line 1B-1B of FIG. 1A.

Referring to the drawings, FIGS. 1-1B illustrate a DTH drill hammer 100 in accordance with an exemplary embodiment of the subject disclosure. The DTH drill hammer 100 comprises a casing 102, a chuck 104, a drill bit 108 and a bit retaining ring 110. In accordance with another exemplary embodiment the DTH drill hammer consists essentially of the casing 102, the chuck 104 connectable to the casing, and the bit retaining ring 110 between the casing and the chuck.

Referring to FIGS. 1A and 1B, the DTH percussive drill hammer 100 further includes a valve assembly 112, a piston 114 axially movable in the casing 102, and a backhead 116. The backhead is threadedly connected to a proximal threaded end 118 of the casing 102 and has a proximal threaded end 120 for connection to an unillustrated drill pipe or drill string. Operation of conventional aspects of a percussive DTH drill hammer is known in the art and a detailed description thereof is not necessary for a complete understating of the subject disclosure. The valve assembly 112 is a poppet valve for allowing working fluids to enter the drill hammer's internal fluid conduits, drive chamber, return chamber and porting system.

Figure 2:
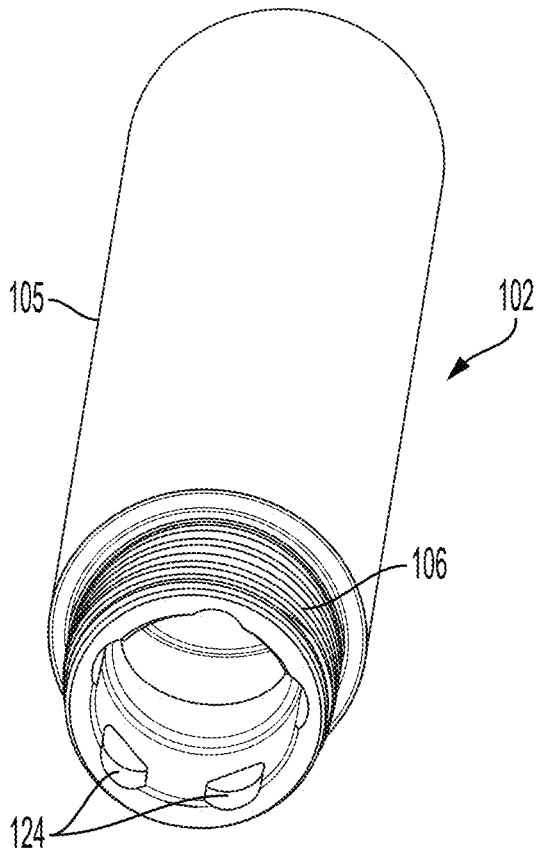
FIG. 2 is a bottom perspective view of a casing of the DTH drill hammer of FIG. 1.
Figure 2A:
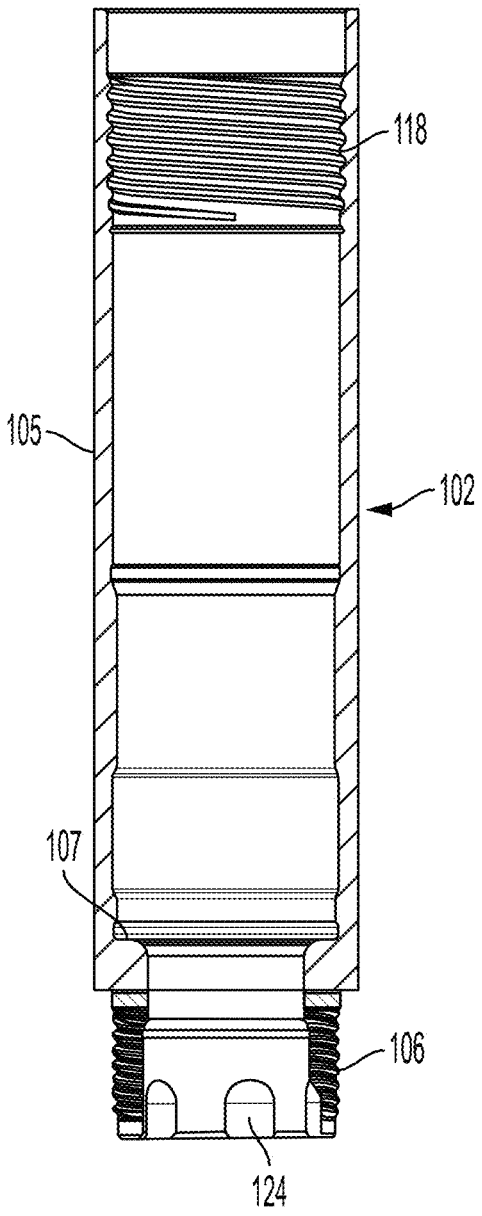
FIG. 2A is a longitudinal cross-sectional view of the casing of FIG. 2.

FIGS. 2 and 2A illustrate in greater detail an exemplary embodiment of the casing 102 according to the subject disclosure. The casing is a generally cylindrical casing having a main portion 105 and a threaded distal end 106. In an exemplary embodiment, the casing 102 has an overall length extending from the backhead 116 to the drill bit retaining ring 110/chuck 108 and houses the valve assembly 112, the piston 114, a porting system and a portion of the drill bit 108. The overall length of the casing can be about, e.g., 25 inches (63.5 cm), including 20, 21, 22, 23, 24, 26, 27, 28, 29 or 30 or more inches (50.8, 53.3, 55.9, 58.4, 61.0, 66.0, 68.6, 71.1, 73.7 or 76.2 cm)

The main portion 105 of the casing 102 includes the proximal threaded end 118 which has internal threads for threadedly receiving the backhead 116. The proximal threaded end 118 is formed along the proximal end of the main portion of the casing. The main portion has a constant diameter throughout its longitudinal length. The threaded distal end 106 is an externally threaded distal end. The externally threaded distal end is a narrower or smaller diameter end relative to the main portion 105 and extends radially inwardly from the main portion. That is, the distal end of the casing has an overall outside diameter smaller than an overall outside diameter of the main portion of the casing.

In addition, the externally threaded distal end 106 of the casing 102 forms an internal shoulder or step 107. The internal shoulder is a radially inwardly directed shoulder or step. The radially inwardly extending shoulder 107 is adjacent the externally threaded distal end 106 and sized to engage a portion of the piston 114 as it moves percussively therein. For example, as best shown in FIG. 1A, the shoulder is sized to engage a midportion of the piston while the threaded distal end is sized to allow a distal most end of the piston to pass therethrough. The threaded distal end is also configured to include a plurality of splines 124. The plurality of splines is formed along an inner surface of a distal end of the threaded distal end.

Figure 3:
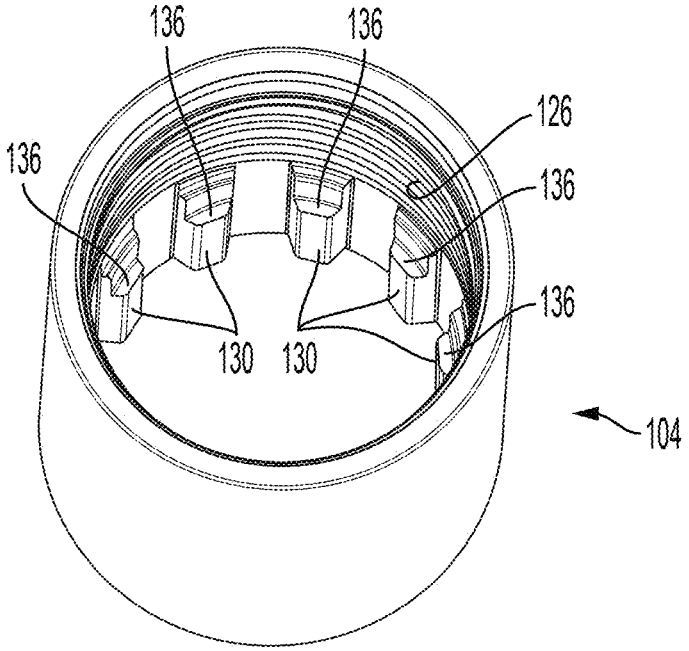
FIG. 3 is a top perspective view of a chuck of the DTH drill hammer of FIG. 1.
Figure 3A:
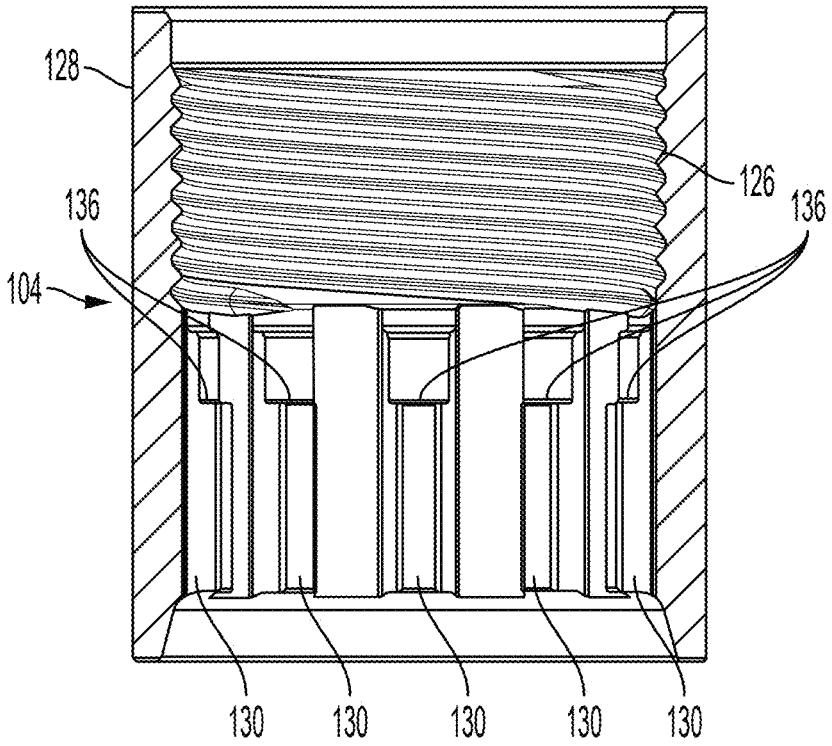
FIG. 3A is a longitudinal cross-sectional view of the chuck of FIG. 3.

FIGS. 3 and 3A illustrate in greater detail an exemplary embodiment of the chuck 104 according to the subject disclosure. The chuck is a substantially cylindrical chuck having an overall outside diameter substantially the same as an overall outside diameter of the main portion 105 of the casing 102. An overall length of the chuck can range from about 6 to 12 inches (15.2 to 30.5 cm), including 7, 8, 9, 10, 11 or more inches (17.8, 20.3, 22.9, 25.4 and 27.9 cm). The chuck has internal threads 126 about a proximal end 128 thereof for receiving the externally threaded distal end 106 of the casing 102. The chuck is unitary in construction with splines 130 disposed distally to its internally threaded proximal end 128.

The splines 130 include a plurality of axially extending and circumferentially spaced apart splines which are adapted to cooperate with corresponding splines 132 (FIGS. 1A, 1B and 5) provided on a shank 134 of the drill bit 108 so as to allow the drill bit to move axially thereby. The splines 130 can include e.g., 1, 2, 3, 4, 5, 6, 7, 8, 9, 10, 11, 12 or more splines.

Figure 5:
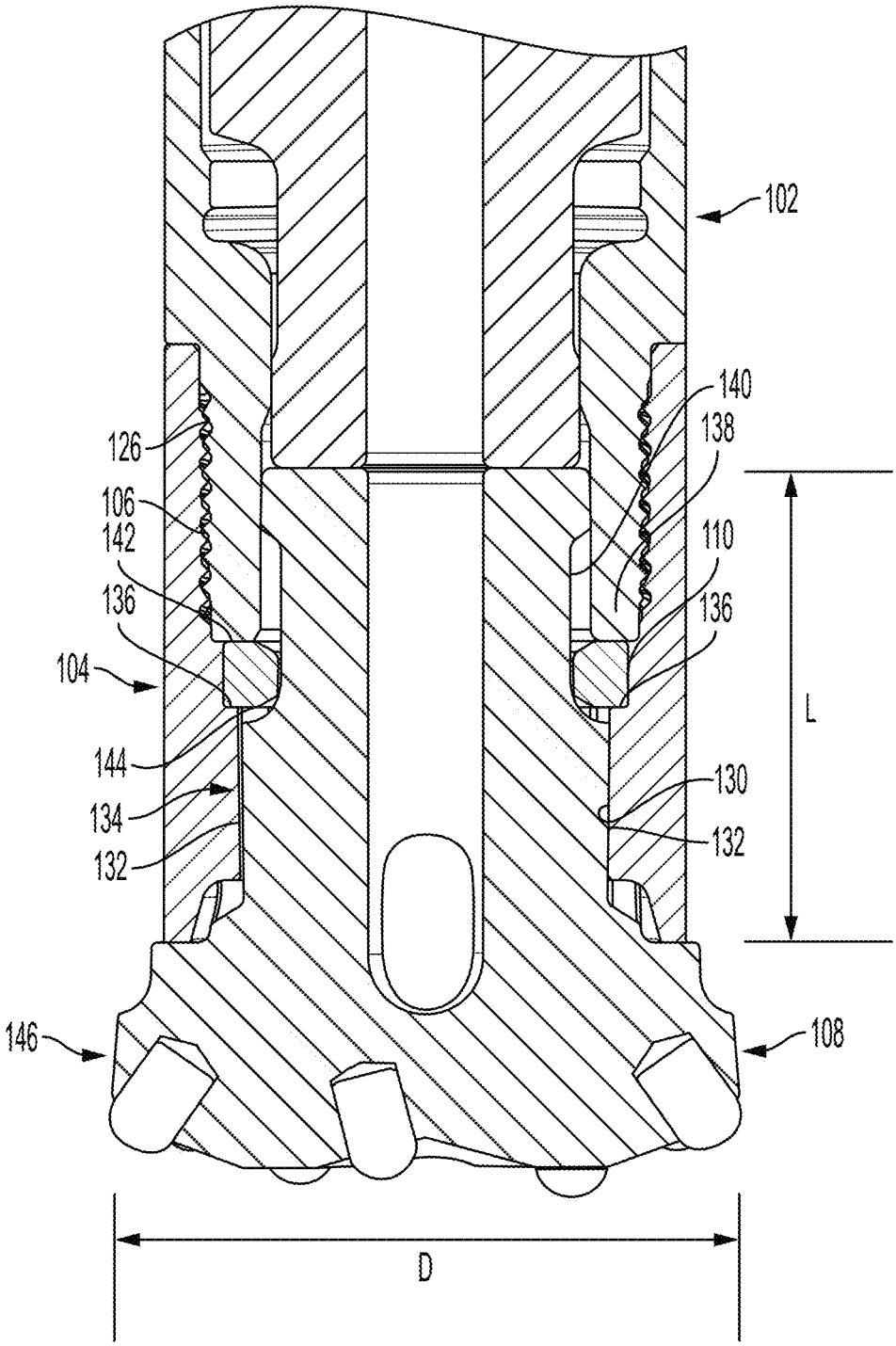
FIG. 5 is an enlarged longitudinal cross-sectional view of a distal end of the DTH drill hammer of FIG. 1.

As shown in FIG. 3A, the upper end of each of the plurality of splines 130 is provided with a step or shoulder 136 for receiving and supporting the drill bit retaining ring 110 (FIG. 5). Each step or shoulder extends radially inwardly about a midpoint of a longitudinal length of the chuck and has an overall longitudinal length or height substantially the same as an overall longitudinal length or height of the drill bit retaining ring. Each of the plurality of splines 130 has an overall length of about 2 inches (5.1 cm), about 2.5 inches (6.4 cm), about 3.0 inches (7.6 cm), or about 3.5 inches (8.9 cm), so as to extend to about a midportion of the chuck. The plurality of splines 130 also extend radially inwardly greater or further than the internally threaded proximal end of the chuck.

Since the distal end of the chuck 104 is not located within the casing 102, the overall dimensions of the distal end of the chuck are not restricted by the internal dimensions of the casing. Thus, the distal end of the chuck can be made larger, thereby allowing the overall diameter of the drill bit shank 134 to be made larger than conventional drill bit shanks. For example, the chuck has an overall internal outside diameter larger than the outside diameter of casing for operatively engage with a drill bit having a shank with an overall shank diameter that this larger than the overall casing diameter. This is advantageous since a larger shank diameter allows for greater torque. In addition, the overall diameter of the shank splines 132 can be made substantially equal to or greater than the bore diameter of the casing 102 (see FIG. 1B).

Figure 4:
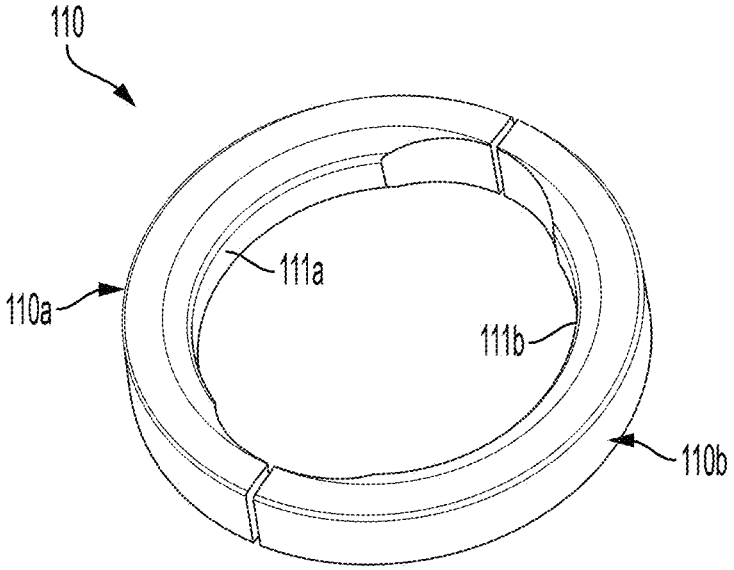
FIG. 4 is a perspective view of a bit retaining ring in accordance with the DTH drill hammer of FIG. 1.

The bit retaining ring 110 is configured as best shown in FIGS. 4 and 5. The bit retaining ring 110 is situated between a distal edge 138 of the casing and the shoulder 136 of the chuck for releasably retaining the drill bit within the drill hammer. The bit retaining ring is sized to fit within the chuck and circumscribe a portion of the drill bit shank. Specifically, as best shown in FIG. 4, the bit retaining ring is constructed as a two-part ring 110*a*, 110*b* having radially inwardly projecting portions 111*a*, 111*b* sized to circumscribe a reduced diameter portion 140 (FIGS. 1A, 1B and 5) of the drill bit shank 134 which limits axial movement of the drill bit. The bit retaining ring is also sized to have an thickness (i.e., outer diameter minus inner diameter dimension) that substantially matches a space defined by the chuck and the reduced diameter portion of the shank.

As best shown in FIG. 5, the bit retaining ring 110 is positioned or situated completely below the casing and includes a planar top surface 142 and a planar bottom surface 144, whereby the bit retaining ring is firmly retained between the casing 102 and the chuck 104. More particularly, the bit retaining ring is adjacent a most distal end of the casing. Further, an internal diameter of the bit retaining ring is less than an internal diameter of the distal end of the casing.

Referring to FIG. 5, there are shown exemplary dimensions of the drill bit 108 which are achievable by virtue of the threaded connection between the externally threaded distal end 106 of the casing 102 and the internally threaded proximal end 128 of the chuck 104. More particularly, the length "L" of the bit shank 134 is less than about the overall diameter "D" of the drill bit head 146. According to an exemplary aspect, the length of the drill bit shank is about 0.75 or ¾ the overall diameter of the drill bit head. or about 0.6, 0.65, 0.70, 0.80, 0.85 of the overall diameter of the drill bit head 146. An exemplary diameter of the bit head 146 is, e.g., 6 inches (15.2 cm). D can also range from about 3 inches (7.6 cm) to about 12 inches (30.5 cm), including about 4, 5, 7, 8, 9, 10 and 11 inches (10.2, 12.7, 17.8, 20.3, 22.9, 25.4 and 27.9 cm) and L will be a fraction of D as set forth above. In addition, according to an exemplary embodiment of the subject disclosure, the drill bit 108 is constructed as a unitary drill bit. The combination of the short drill bit shank with the subject casing and chuck advantageously allows for drill bit to have an overall weight that is less than an overall weight of conventional drill bits.

In accordance with an aspect of the subject disclosure, the overall weight of the drill bit is sized and/or configured to be substantially the same as an overall weight of the piston. This weight matching of the drill bit and piston advantageously provides for improved force transfer in various rock formations.

The threads on the casing are external threads and the interface between the chuck and casing at the distal end of the casing allow for the bit retaining ring 110 to be captured or situated therebetween. That is, the bit retaining ring is positioned between the casing and the chuck. This configuration of the casing and chuck positions the bit retaining ring at an axial location that is closer to the drill bit head shoulder compared to traditional or conventional DTH casings. This positioning of the bit retaining ring relative to the drill bit head shoulder allow for the drill bit shank to be a short or shortened shank, such has a shank having a length of about 0.6 of 3 inches (7.6 cm) to about 0.85 of 12 inches (30.5 cm), or about 1.8 inches (4.6 cm) to 10.2 inches (25.9 cm).

The subject DTH drill hammer advantageously allows for the drill hammer to eliminate the need for two components, a piston retaining ring, and a bit bearing. Moreover, a shorter overall drill hammer and drill bit is advantageous as it provides for a lighter, easier to handle, tool that requires less headroom to install on a drill rig.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the claims appended hereto.

We claim:

1. A down-the-hole drill hammer comprising:

a casing having an externally threaded distal end;

a chuck having internal threads threadedly connectable to the distal end of the casing;

a drill bit having a head and a shank extending proximally from the head, wherein a length of the drill bit shank is about 0.6 to about 0.85 of an overall diameter of the drill bit head; and a bit retaining ring between the casing and the chuck for releasably retaining the drill bit.

2. The down-the-hole hammer of claim 1, wherein a length of the drill bit shank is about ¾ of an overall diameter of the drill bit head.

3. The down-the-hole hammer of claim 1, wherein the chuck includes a shoulder.

4. The down-the-hole hammer of claim 1, wherein the chuck includes a shoulder extending radially inwardly about a midpoint of a longitudinal length of the chuck.

5. The down-the-hole hammer of claim 1, wherein the internal threads of the chuck are positioned about a proximal end of the chuck.

6. The down-the-hole hammer of claim 1, wherein the chuck includes a plurality of splines.

7. The down-the-hole hammer of claim 1, wherein the chuck includes a plurality of splines about a distal end of the chuck.

8. The down-the-hole hammer of claim 1, wherein the chuck includes a plurality of splines each having a radially inwardly extending step.

9. The down-the-hole hammer of claim 1, wherein the chuck has an overall outside diameter substantially the same as an overall outside diameter of a main portion of the casing.

10. The down-the-hole hammer of claim 1, wherein the bit retaining ring includes a planar top surface and a planar bottom surface.

11. The down-the-hole hammer of claim 1, wherein the bit retaining ring is completely below the casing.

12. The down-the-hole hammer of claim 1, wherein the bit retaining ring is adjacent a most distal end of the casing.

13. The down-the-hole hammer of claim 1, wherein the bit retaining ring is sized to fit within the chuck.

14. The down-the-hole hammer of claim 13, wherein the internal diameter of the bit retaining ring is less than an internal diameter of the distal end of the casing.

15. The down-the-hole hammer of claim 1, wherein the chuck and the drill bit shank have cooperating splines whereby the drill bit is axially movable relative to the chuck.

16. The down-the-hole hammer of claim 1, wherein the distal end of the casing has an overall outside diameter smaller than an overall outside diameter of a main portion of the casing.

17. The down-the-hole hammer of claim 1, wherein the externally threaded distal end extends radially inwardly from a main portion of the casing.

18. The down-the-hole hammer of claim 1, wherein the externally threaded distal end forms a radially inwardly extending shoulder.

19. The down-the-hole hammer of claim 1, wherein the casing includes a radially inwardly extending shoulder adjacent the externally threaded distal end.

20. A down-the-hole drill hammer comprising:

a casing having an externally threaded distal end;

a chuck having internal threads threadedly connectable to the distal end of the casing and a plurality of splines each having a radially inwardly extending step;

a drill bit having a head and a shank extending proximally from the head; and a bit retaining ring between the casing and the chuck for releasably retaining the drill bit.

* * * * *